US009356361B2

(12) United States Patent
Wang et al.

(10) Patent No.: US 9,356,361 B2
(45) Date of Patent: May 31, 2016

(54) ELECTRICAL CONNECTOR FOR STRIP CABLE

(71) Applicant: Tyco Electronics (Shanghai) Co. Ltd., Shanghai (CN)

(72) Inventors: Hao Wang, Shanghai (CN); Qijun Zhao, Shanghai (CN); Xiang Xu, Shanghai (CN); Tandy Tang, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/528,570

(22) Filed: Oct. 30, 2014

(65) Prior Publication Data

US 2015/0118891 A1 Apr. 30, 2015

(30) Foreign Application Priority Data

Oct. 30, 2013 (CN) ..... 2013 2 0678045 U

(51) Int. Cl.

| | |
|---|---|
| ***H01R 11/20*** | (2006.01) |
| ***H01R 4/24*** | (2006.01) |
| ***H01R 4/26*** | (2006.01) |
| ***H01R 9/03*** | (2006.01) |
| *H01R 13/52* | (2006.01) |

(52) U.S. Cl.

CPC ..... *H01R 4/2483* (2013.01); *H01R 9/031* (2013.01); *H01R 13/5213* (2013.01)

(58) Field of Classification Search

CPC .. H01R 4/2483; H01R 9/031; H01R 13/5213; H01R 4/24

USPC ..... 439/416, 138, 272, 271, 274, 275, 279

See application file for complete search history.

(56) References Cited

U.S. PATENT DOCUMENTS 7,520,771 B2 * 4/2009 Nall ..... F21V 21/002 439/417

* cited by examiner

*Primary Examiner* — Javaid Nasri

(74) *Attorney, Agent, or Firm* — Barley Snyder

(57) ABSTRACT

An electrical connector is disclosed having a body with a cable receiving space, and at least two rows of first through holes. At least two conductive plates are positioned on the upper surface of the body, each conductive plate having at least two second through holes positioned over the corresponding first through holes. A first and second strip cable is positioned in the cable receiving space, each cable having an insulation layer, and at least two conductors embedded in the insulation layer. At least four conductive bolts are provided, each bolt positioned through the first and second through holes, through the insulation layer, and in contact with the conductor.

16 Claims, 4 Drawing Sheets

Prior Art

ELECTRICAL CONNECTOR FOR STRIP CABLE

CROSS-REFERENCE TO RELATED APPLICATION

This application claims priority under §119(a)-(f) to Chinese Patent Application No. 201320678045.5 filed on Oct. 30, 2013.

FIELD OF THE INVENTION

The invention is generally related to an electrical connector, and, more specifically, a miniature electrical connector for connecting strip cables.

BACKGROUND

Conventionally, strip cables are often used to supply electrical power to a low power electronic device, such as an indoor and outdoor light-emitting diode (LED). As shown in FIG. 1, a conventional strip cable 200 has a substantially flat shape, with two conductors 202 positioned within an insulation layer 201.

As shown in FIG. 2, a convention electrical connector 300 has a cuboidal body 301, a through hole 302 extending through the body 301, and a cap 303. Two rows of pins (not shown) are positioned inside the cap 303, with at least two pins of each row electrically connected to each other. The pins in the two rows are electrically insulated from each other. When two conventional strip cables 200 are connected to the conventional electrical connector 300, the ends of two strip cables 200 are inserted into the through hole 302 from two opposing ends of the body 301, and the cap 303 is press fitted onto the body 301. When the cap 303 is press fitted, the pins inside the cap pass through corresponding holes formed on the body and enter into the through hole 302. As the pins enter the through hole 302, they pierce the insulating layers 201 and contact corresponding conductors 202, achieving the electrical connection of corresponding conductors of two cables 200.

There are several disadvantages associated with this conventional design. First, the cap and pins are bulky and are limited in how much they can be reduced in size without destroying the conventional electrical connector's functionality. Secondly, the conventional electrical connector has poor waterproof performance. Lastly, a user cannot observe the quality of the electrical connection between the pins and the conductors, so the reliability of the electrical connection is difficult to measure.

Therefore, there is a need for an electrical connector that overcomes the above disadvantages.

SUMMARY

An electrical connector having a body with a cable receiving space, and at least two rows of first through holes. At least two conductive plates are positioned on the upper surface of the body, each conductive plate having at least two second through holes positioned over the corresponding first through holes. A first and second strip cable is positioned in the cable receiving space, each cable having an insulation layer, and at least two conductors embedded in the insulation layer. At least four conductive bolts are provided, each bolt positioned through the first and second through holes, through the insulation layer, and in contact with the conductor.

BRIEF DESCRIPTION OF THE DRAWINGS

The invention will now be described by way of example, with reference to the accompanying drawings, of which.

DETAILED DESCRIPTION

Figure 1:
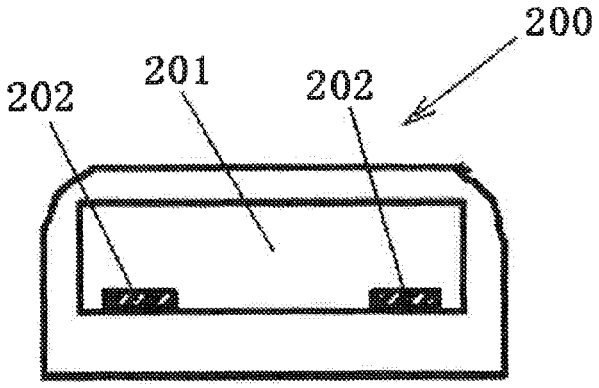
Fig. 1 Prior Art
FIG. 1 is a schematic cross-sectional view of a conventional strip cable.
Figure 2:
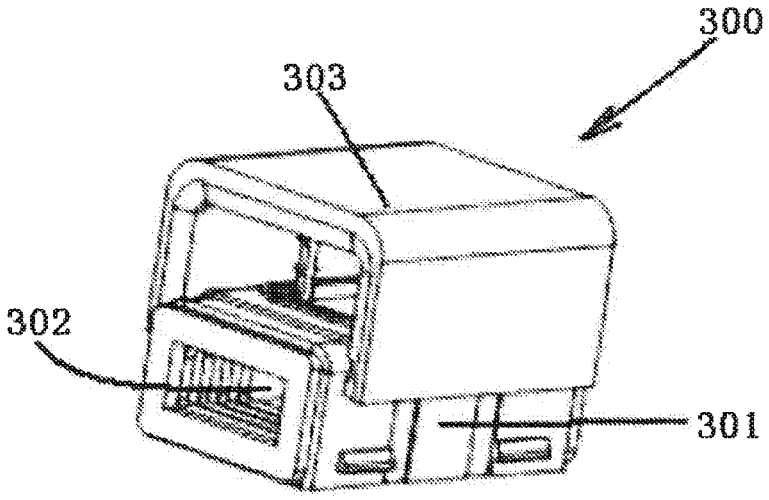
FIG. 2 is a perspective view of a conventional electrical connector for connecting strip cables.

In the following detailed description, for purposes of explanation, numerous specific details are set forth in order to provide a thorough understanding of the disclosed embodiments. It will be apparent to those of ordinary skill in the art, however, that one or more embodiments may be practiced without these specific details. In other instances, well-known structures and devices are schematically shown in order to simplify the drawing.

Figure 3:
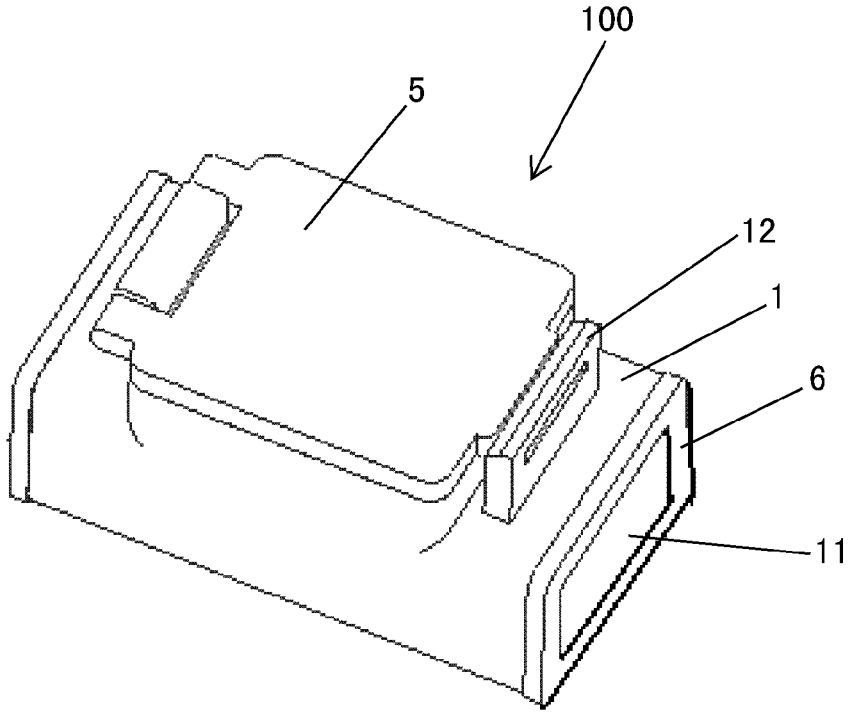
FIG. 3 is a perspective view of an electrical connector.
Figure 4:
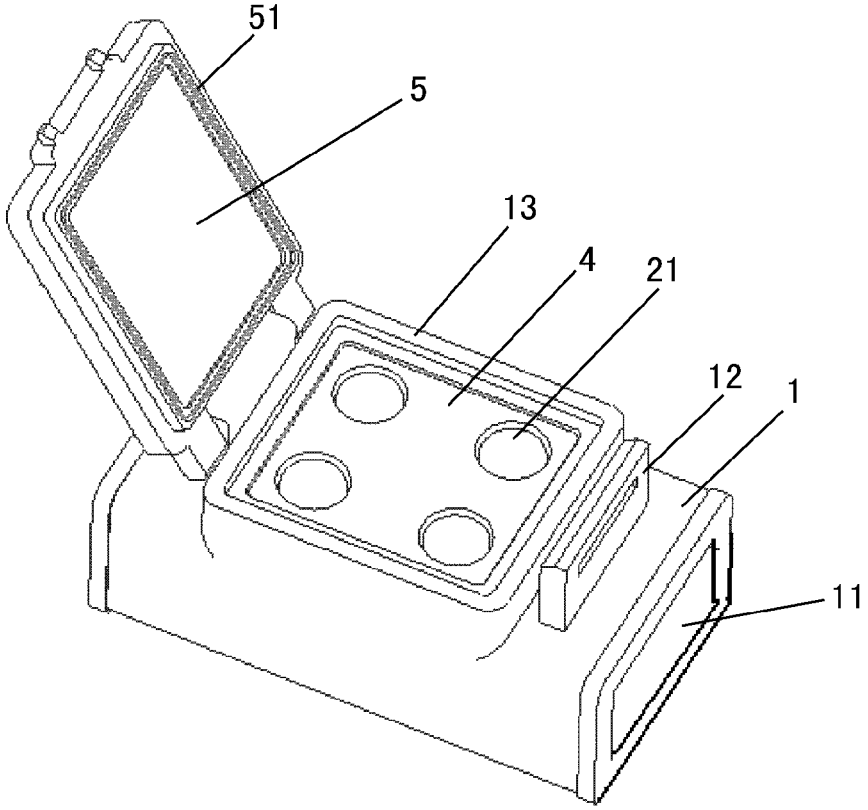
FIG. 4 is a perspective view of the electrical connector of FIG. 3 having an opened cap.
Figure 5:
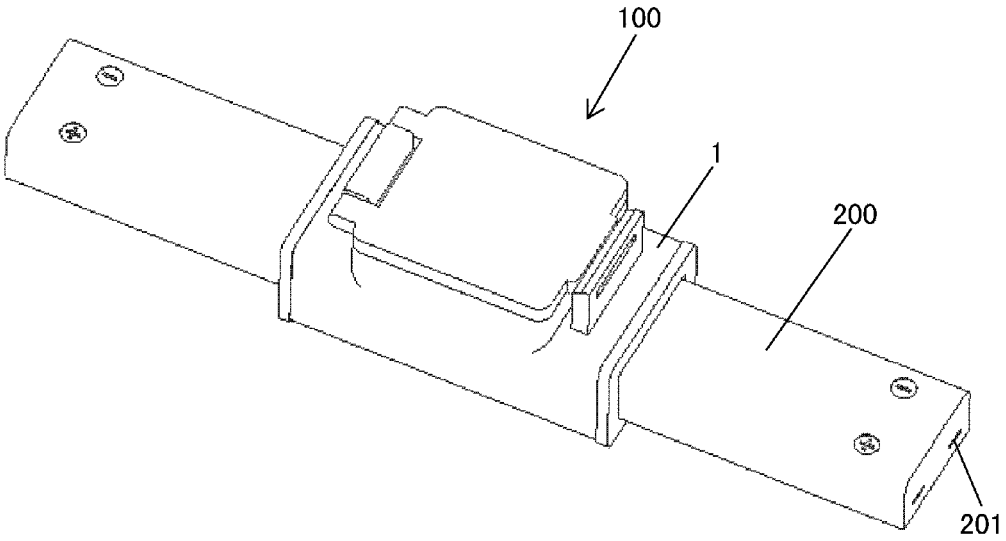
FIG. 5 is a perspective view of two strip cables connected by the electrical connector of FIG. 3.
Figure 6:
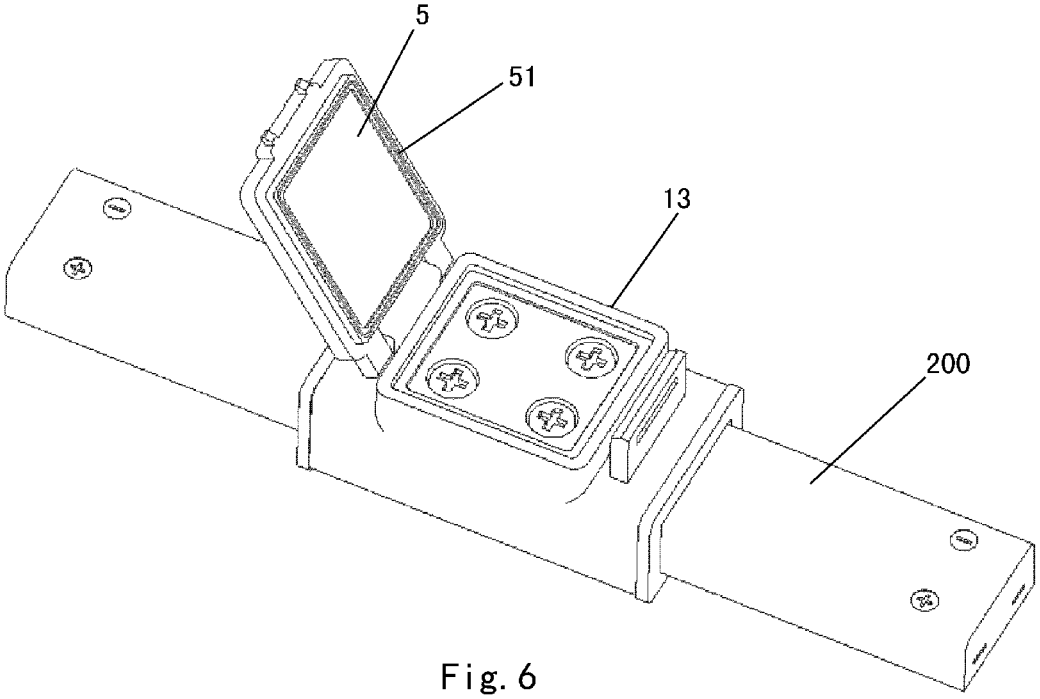
FIG. 6 is a perspective view of the electrical connector of FIG. 5 having the opened cap.

In an embodiment of FIGS. 3 and 4, an electrical connector 100 connects two strip cables 200, each cable 200 having an insulation layer 201 and at least two conductors 202 embedded in an insulation layer 201. In an embodiment, the conductors 202 are wires.

The electrical connector 100 has a body 1, at least two conductive plates 2 (see FIG. 7) and at least four conductive bolts 3. The body 1 is made of an insulating material such as plastic, and has one or more cable receiving spaces 11 and at least two rows of first through holes (not shown). The cable receiving spaces 11 are generally cuboidal and extend through the body 1 along a longitudinal axis. The first through holes (not shown) are formed in an upper surface of the body 1 and extend from the upper surface into the cable receiving space 11. At least two conductive plates 2 are positioned on the upper surface of the body 1, extending parallel along the longitudinal axis. In an embodiment of FIG. 7, each conductive plate 2 has at least two second through holes 21. In the embodiment of FIG. 8, each conductive bolt 3 is inserted through the first through hole and the second through hole 21 and pierces the insulation layer 201 of the corresponding cable 200 positioned in the cable receiving space 11. The conductive bolt 3 contacts the conductor 202 within the cable 200, so that one conductor 202 of one cable 200 is electrically connected with one corresponding conductor 202 of the other cable 200 through at least two conductive bolts 3 and one conductive plate 2.

The electrical connector 100 may be used for supplying electrical power and/or communication signal to an electronic device, such as an indoor and outdoor illuminating device. Examples of the electronic device may include a LED illuminating lamp, or an energy-saving, low power lamp. Such electrical connector 100 may also be used with a signal illuminating device, and have a thin and signal-row structure so as to realize a free-hanging wire-to-wire connection.

Figure 7:
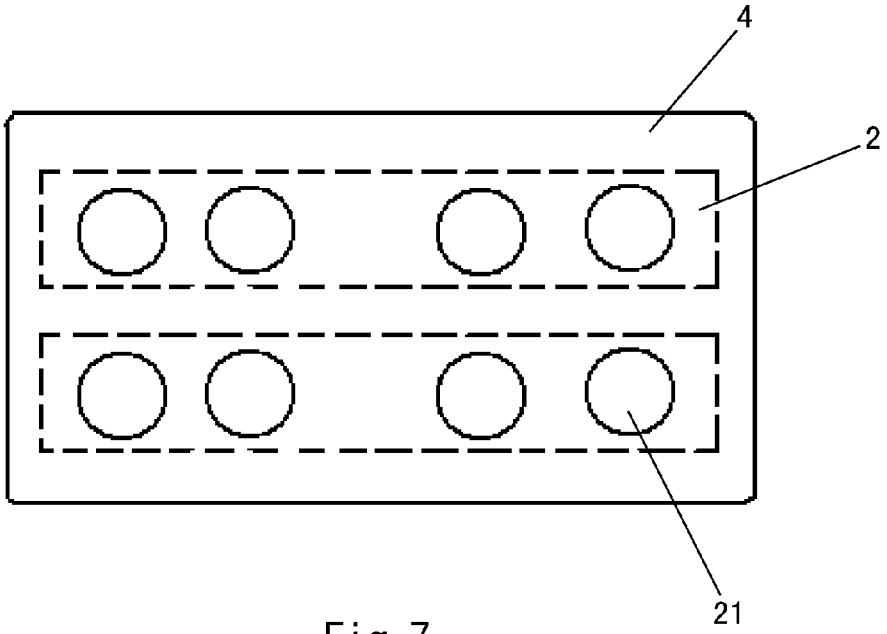
FIG. 7 is a plan view of conductive plates and an insulation support.
Figure 8:
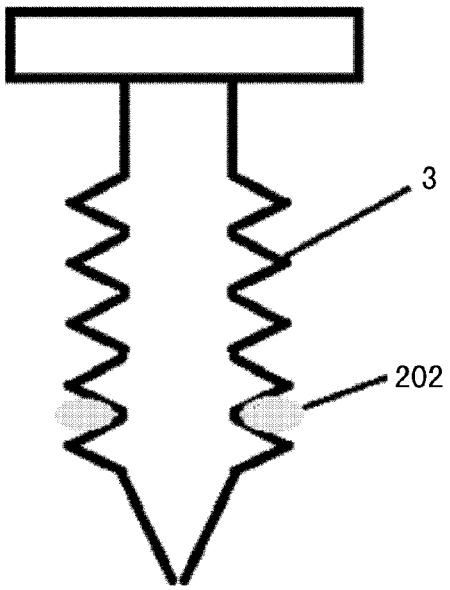
FIG. 8 is a schematic view of a connection between a conductive bolt and a wire of the cable.

In an embodiment of FIG. 7, two conductive bolts 3 pierce into each conductor 202 so as to establish a reliable electrical connection between the conductive bolts 3 and the conductor 202. In another embodiment, only one conductive bolt 3 may pierce into each conductor 202 to establish a reliable electrical connection. Generally, the conductive bolt 3 may a sharp end to pierce the insulation layer 201 and the conductor 202 of corresponding cable 200 by using a relatively weak force.

In an embodiment of FIG. 4, the electrical connector 100 has an insulation support 4, onto which the conductive plates 2 are positioned. In an embodiment, the two conductive plates 2 are attached to the insulation support 4 by over-molding. The through holes 21 on the conductive plate 2 extend through the insulation support 4 such that an inserted conductive bolt 3 extends through the conductive plate 2 and the insulation support 4, into the cable receiving space 11.

In the embodiments of FIGS. 3-6, the electrical connector 100 has a cap 5 that covers the insulated support 4. A first end of the cap 5 is pivotally connected to the upper surface of the body 1 through a hinge. An opposite second end of the cap 5 includes a cap locking mechanism (not labeled) that releasably engages with a corresponding locking mechanism 12 positioned on the upper surface of the body 1. In an exemplary embodiment, the cap locking mechanism on the second end of the cap 5 engages to the locking mechanism 12 in a snap-fit manner.

In an embodiment of FIG. 4, a flange 13 protrudes outward from the upper surface of the body 1 and extends along a periphery of the insulation support 4. An interior facing surface of the cap 5 has a sealing gasket 51 that contacts the flange 13 when the cap 5 is closed and locked to the body 1. The sealing gasket 51 and flange 13 create a waterproofing seal that protects the insulation support 4 and conductive bolts 3.

The cap 5 may be made of transparent material so that the connection status of the conductive bolts 3 within the cap 5 may be observed, or may be made of an opaque material.

In an embodiment, the cable receiving space 11 is a through hole extending through the body 1 along the longitudinal axis, from a first end to an opposite second end of the body 1. A first cable 200 and a second cable 200 may be inserted into the cable receiving space 11 from the first and second ends of the body 1. In another embodiment, two cable receiving spaces 11 are formed in the body 1 and separated by a partition portion (not shown) located in an approximate middle of the body 1, such that two cables may be inserted into the first and second ends of the body 1, and terminate at the approximate middle of the body 1.

In an embodiment of FIG. 3, elastic sealing members 6 are attached to the first and second ends of the body 1, and surround the opening of the cable receiving spaces 11 thereon. When the cables 200 are positioned in the cable receiving space 11, the elastic sealing members 6 elastically and continuously contact an outer circumferential surface of the cables 200. Contamination, such as water and ash, is prevented from entering into the interior of the cable receiving space 11, and the water-proof effect of the electrical connector 100 is improved.

In an embodiment, the body 1 is made of transparent material such that the insertion status of cables within the cable receiving spaces 11 can be observed so as to determine whether the cable is mounted in place. In another embodiment, the body 1 is made of an opaque material.

Assembly of the major components will now be described in detail.

When the strip cables 200, shown in FIG. 1, need to be connected together, end portions of two cables 200 are inserted into the cable receiving space 11 from two ends of the body 1, with one cable 200 inserted in the first end opening of the body 1, and the second cable 200 inserted in the second end opening of the body 1. A user then verifies that the two cables 200 are fully inserted into the body 1, and that each terminates at the approximate middle of the body 1. The insulation support 4 is then mounted on the upper surface of the body 1. Next, using a screwdriver or the like, conductive bolts 3 are each inserted in the corresponding second through hole 21 in the insulation support and the first through hole in the body 1, and screwed into the insulation layer 201 of the corresponding cable 200. The conductive bolts 3 are screwed into the insulation layer 201 until they pierce the conductor 202 (as shown in FIG. 8), so that the corresponding conductors 202 of two strip cables are electrically connected to each other by at least two conductive bolts 3 and one conductive plate 4. Lastly, the cap 5 is pivoted downward against the flange 13 and snap-fitted to the body 1 through the locking mechanism 12.

Although the electrical connector 100 shown in attached drawings is used to connect the cables 200 having two conductors 200, the present invention is not limited thereto. In other embodiments, the electrical connector 100 may connect 3, 4 or more strips of cables 200. In another embodiment, the body 1 may have a plurality of rows of cable receiving spaces 11 extending in parallel along the longitudinal axis, so as to connect a plurality of pairs of cables 200. In an embodiment, the plurality of rows is 3, 4, or 5 or more.

The embodiments of the electrical connector 100 provide a minature and thin electrical connector 100 where the insulation layer and conductors of the cable are pierced by relatively large axial force generated by thread torque of the conductive bolt. A tight electrical connection between the conductive bolt and the conductive plate is therefore formed. Since the conductive bolt is screwed by a screwdriver, no dedicated tools are required, so a simple operation forms a quick electrical connection between two cables 200. Furthermore, the use of the cap 5, the sealing gasket 51, and the elastic sealing members 6 improves the sealing ability of the whole electrical connector 100 and the water-proof performance.

It should be appreciated for those skilled in this art that the above embodiments are intended to be illustrative and not limiting. Many modifications may be made to the above embodiments by those skilled in this art, and various features described in different embodiments may be freely combined with each other without conflicting in configuration or principle, such that on the basis of solving the problem of the present invention, various electrical connectors may be formed.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical connector comprising:

a body having a cable receiving space extending through the body along a longitudinal axis, and at least two rows of first through holes formed in an upper surface of the body and extending from the upper surface into the cable receiving space;

at least two conductive plates positioned on the upper surface of the body extending in parallel along the longitudinal axis, each conductive plate having at least two second through holes positioned over the corresponding first through holes;

a first and second strip cable positioned in the cable receiving space, each cable having an insulation layer, and at least two conductors embedded in the insulation layer;

at least four conductive bolts, each bolt positioned through the first and second through holes, through the insulation layer, and in contact with the conductor, one of the conductors of the first cable being electrically connected with one of the corresponding conductors of the second cable, through at least two of the conductive bolts and one conductive plate.

2. The electrical connector of claim 1, further comprising an insulation support.

3. The electrical connector of claim 2, wherein the conductive plates are positioned on the insulated support.

4. The electrical connector of claim 3, further comprising a cap.

5. The electrical connector of claim 4, wherein a first end of the cap is pivotally connected to the upper surface of the body.

6. The electrical connector of claim 5, wherein the body further comprises a locking mechanism positioned on the upper surface.

7. The electrical connector of claim 6, wherein a corresponding cap locking mechanism is positioned on an opposite second end of the cap, and releasably engages the locking mechanism.

8. The electrical connector of claim 7, wherein the cap locking mechanism engages the locking mechanism in a snap-fitting manner.

9. The electrical connector of claim 5, further comprising a flange protruding outward from the upper surface of the body and extending along a periphery of the insulation support.

10. The electrical connector of claim 9, further comprising a sealing gasket positioned on an interior side of the cap and contacting the flange when the cap is closed.

11. The electrical connector of claim 4, wherein the cap is made of a transparent material.

12. The electrical connector of claim 1, wherein the cable receiving space is a through hole extending through the body.

13. The electrical connector of claim 1, wherein the cable receiving space is divided into two cable receiving spaces separated by a partition located in an approximate middle of the body.

14. The electrical connector of claim 1, further comprising a first elastic sealing member attached to a first end of the body and surrounding an opening of the cable receiving space thereon.

15. The electrical connector of claim 1, further comprising a second elastic sealing member attached to a second end of the body and surrounding an opening of the cable receiving space thereon.

16. The electrical connector of claim 1, wherein the body is made of transparent material.

* * * * *